US009322605B1

(12) United States Patent
Noyons et al.

(10) Patent No.: US 9,322,605 B1
(45) Date of Patent: Apr. 26, 2016

(54) TRIGGER MECHANISM GUARD ASSEMBLY AND METHOD OF USE

(71) Applicant: KARGYLE L.L.C., Beaver Dam, WI (US)

(72) Inventors: Garret Noyons, Beaver Dam, WI (US); Kyle Frake, Beaver Dam, WI (US)

(73) Assignee: Kargyle L.L.C., Beaver Dam, WI (US)

( * ) Notice: Subject to any disclaimer, the term of this patent is extended or adjusted under 35 U.S.C. 154(b) by 0 days.

(21) Appl. No.: 14/633,990

(22) Filed: Feb. 27, 2015

(51) Int. Cl.
*F41A 17/00* (2006.01)
*F41A 17/54* (2006.01)

(52) U.S. Cl.
CPC ..... *F41A 17/54* (2013.01)

(58) Field of Classification Search
CPC ..... F41A 17/46; F41A 17/02; F41A 17/22; F41A 19/09; F41A 19/11; E05B 73/00
USPC ..... 42/70.06, 70.07
See application file for complete search history.

(56) References Cited

U.S. PATENT DOCUMENTS

| | | | | | |
|---|---|---|---|---|---|
| 1,686,482 | A | * | 10/1928 | Windle | 42/70.07 |
| 1,887,308 | A | | 12/1931 | Jessup | |
| 2,505,227 | A | * | 4/1950 | Charters | 42/70.06 |
| 2,589,227 | A | * | 3/1952 | Colley | 42/69.01 |
| 3,392,471 | A | * | 7/1968 | Foote | 42/70.06 |
| 4,030,221 | A | | 6/1977 | Doobenen et al. | |
| 4,916,842 | A | * | 4/1990 | Hardy | 42/70.07 |
| 4,934,083 | A | * | 6/1990 | Smith | 42/70.07 |
| 5,012,605 | A | | 5/1991 | Nishioka | |
| 5,054,222 | A | * | 10/1991 | Hardy | 42/70.07 |
| 5,075,994 | A | * | 12/1991 | Nishioka | 42/70.07 |
| 5,309,661 | A | | 5/1994 | Fuller et al. | |
| 5,680,723 | A | * | 10/1997 | Ruiz | 42/70.11 |
| 5,704,152 | A | | 1/1998 | Harrison et al. | |
| 5,918,402 | A | * | 7/1999 | Weinraub | 42/70.07 |
| 6,154,995 | A | * | 12/2000 | Lenoir et al. | 42/70.07 |
| 6,253,480 | B1 | * | 7/2001 | Florez | 42/70.11 |
| 6,389,726 | B1 | * | 5/2002 | Bentley | 42/70.07 |
| 6,389,727 | B2 | | 5/2002 | Schnell | |
| 6,550,175 | B2 | | 4/2003 | Parker | |
| 8,347,539 | B2 | | 1/2013 | Burns | |

FOREIGN PATENT DOCUMENTS

| | | |
|---|---|---|
| GB | 190906761 | 3/1910 |

* cited by examiner

*Primary Examiner* — Samir Abdosh
(74) *Attorney, Agent, or Firm* — Whyte Hirschboeck Dudek S.C.

(57) ABSTRACT

A trigger mechanism guard assembly includes two arms, each having a first end with a trigger guarding surface and a second end and a housing with substantially parallel side surfaces configured to at least partially enclose the second ends of the arms. The housing is configured to be movable relative to the arms such that the housing has a first position and a second position, the second position being closer to the first ends of the arms compared to the first position. Movement of the housing from the first position to the second position causes movement of the first ends of the arms away from each other.

19 Claims, 14 Drawing Sheets

TRIGGER MECHANISM GUARD ASSEMBLY AND METHOD OF USE

CROSS-REFERENCE TO RELATED APPLICATIONS

None

STATEMENT REGARDING FEDERALLY SPONSORED RESEARCH OR DEVELOPMENT

None

FIELD OF THE INVENTION

The present disclosure relates to a trigger mechanism guard assembly and method of securing at least a portion of a trigger mechanism using a trigger mechanism guard assembly.

BACKGROUND

Most gun and trigger mechanism guards commercially available rely on a keyed lock which allows users to store a firearm in a locked, safe state. Importantly, requiring a key to unlock the trigger mechanism guard prevents children from accidentally accessing the firearm. In the case of an emergency, however, users are left fumbling with a key and lock. Users lose significant time and advantage attempting to open standard gun and trigger mechanism locks when under stress.

Accordingly, there exists a need for a trigger mechanism guard which is capable of safely and securely preventing children from accessing a firearm while allowing quick access to firearm in case of emergency.

SUMMARY

A trigger mechanism guard assembly is disclosed which includes two arms, each having a first end comprising a trigger guarding surface and a second end; a housing having substantially parallel side surfaces, the housing at least partially enclosing the second ends of the arms and configured to be movable with respect to the arms such that the housing has a first position and a second position, wherein the second position is closer to the first ends of the arms compared to the first position, and wherein movement of the housing from the first position to the second position causes movement of the first ends of the arms away from each other.

A trigger mechanism guard assembly is disclosed which includes two arms, each arm having a first end comprising a trigger guarding surface, a second end comprising a spring mechanism-engaging protuberance, and a middle portion connecting the first and second ends and having a slide aperture for receiving a button mechanism insert; a housing at least partially enclosing the second ends and middle portions of the two arms, the housing having two spring mechanism-engaging surfaces each corresponding with a spring mechanism-engaging protuberance and two button cavities for receiving the button mechanism inserts; two spring mechanisms, each spring mechanism having a compressed position and a relaxed position and each spring mechanism engaging one of the spring mechanism-engaging protuberances and secured by the corresponding spring mechanism-engaging surface; and two compressible button mechanism inserts, each engaging both of the slides; and wherein compression of the button mechanism inserts permits movement of housing relative to the two arms to change the springs from the relaxed position to the compressed position.

A method of using a trigger mechanism guard assembly is also disclosed. The method comprises (a) providing a trigger mechanism guard assembly according to any of the embodiments herein described and at least one of (b) removing the trigger mechanism guard assembly from at least a portion of a trigger mechanism and (c) securing the trigger mechanism guard assembly to at least a portion of a trigger mechanism, wherein the step of (b) removing the trigger mechanism guard assembly from at least a portion of a trigger mechanism comprises compressing the button inserts; sliding the housing toward the first end of the arms, thereby causing the two arms to separate; and allowing the trigger mechanism guard assembly to move away from the at least a portion of the trigger mechanism as a single unit; and wherein the step of (c) securing the trigger mechanism guard assembly to at least a portion of a trigger mechanism comprises positioning at least a portion of a trigger mechanism between the trigger mechanism guarding surfaces, compressing the button inserts, and allowing the housing to move away from the first ends of the arms such that the arms close against the at least a portion of the trigger mechanism.

DETAILED DESCRIPTION

Figure 1:
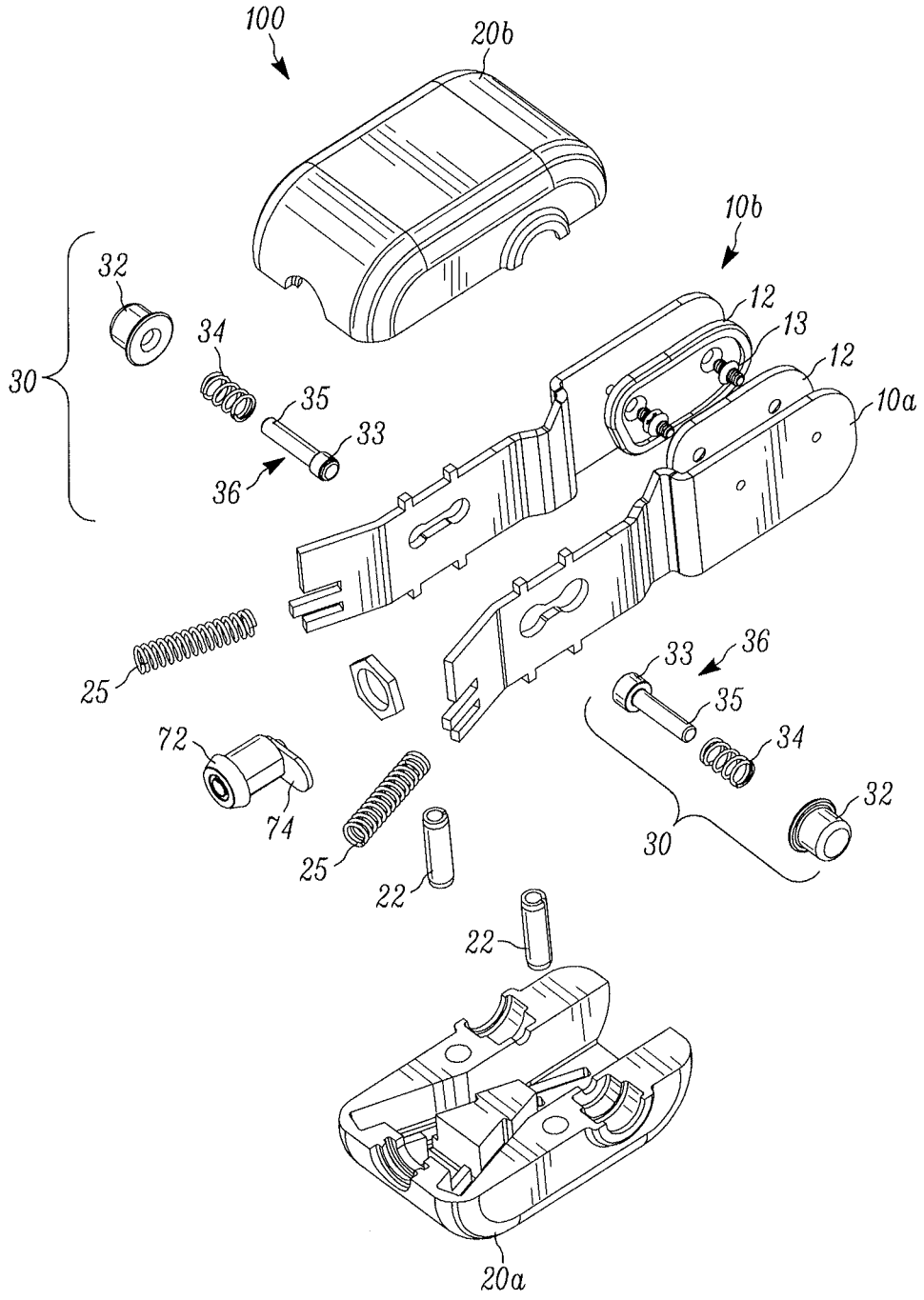
FIG. 1 is an exploded view of an exemplary trigger mechanism guard assembly.
Figure 2A:
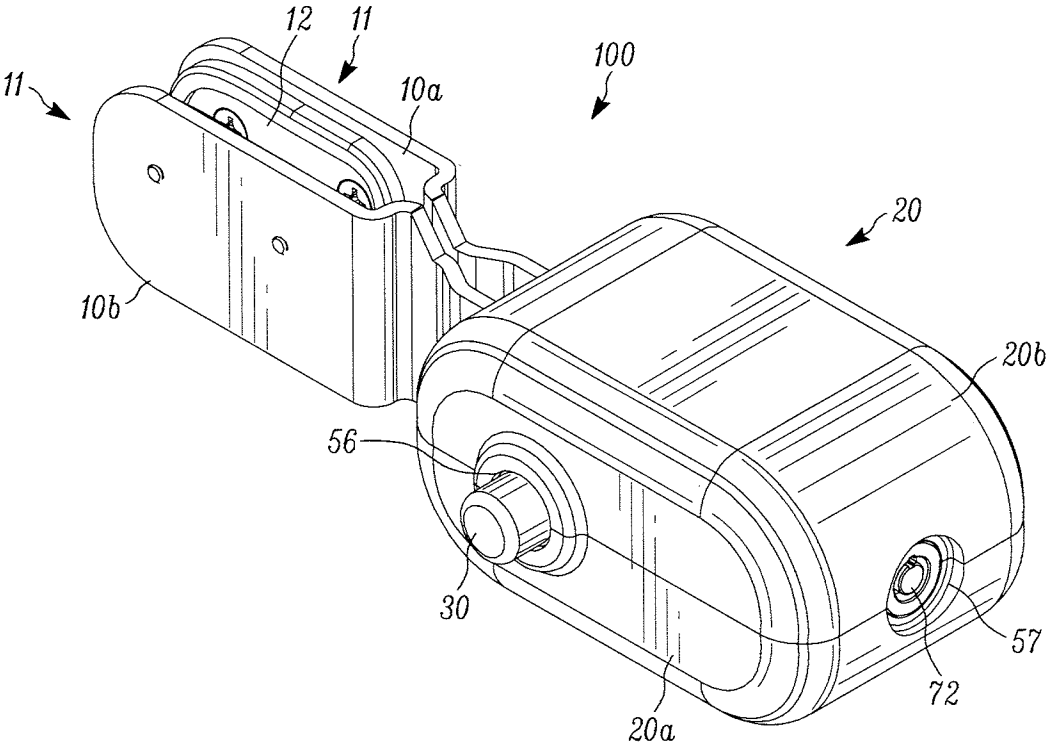
FIG. 2A illustrates the trigger mechanism guard assembly of FIG. 1 fully assembled.

FIG. 1 is an exploded view of an exemplary trigger mechanism guard assembly 100. As illustrated in the embodiment shown in FIG. 1, the trigger mechanism guard assembly 100 includes a pair of arms 10*a*, 10*b*, a housing 20, which in some embodiments comprises a lower portion 20*a* and an upper portion 20*b*, a pair of button mechanisms 30 and a pair of spring mechanisms 25. FIG. 2A shows the exemplary trigger mechanism guard assembly 100 of FIG. 1 fully assembled.

Figure 3A:
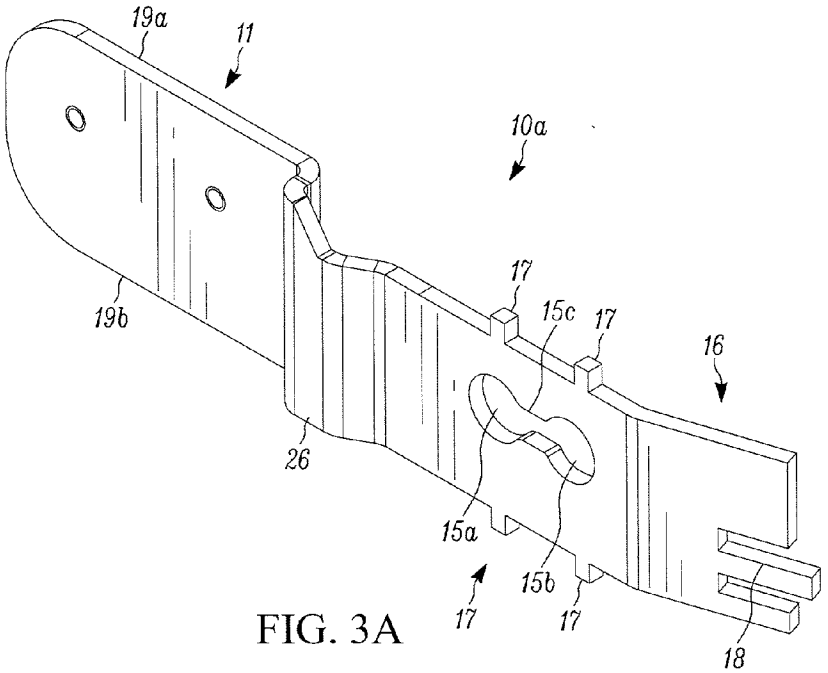
FIGS. 3A-3D illustrate exemplary arms for a trigger mechanism guard assembly.
Figure 3B:
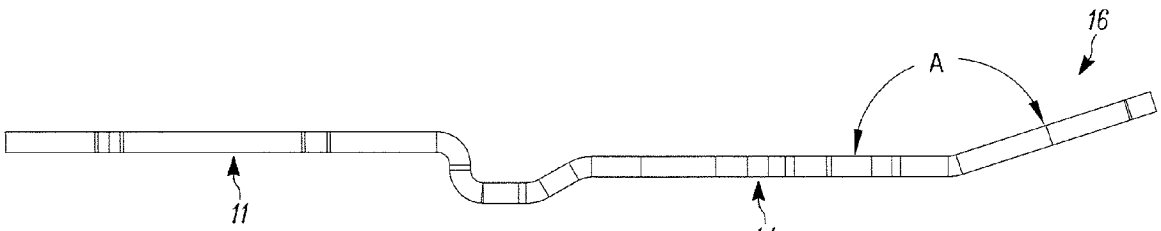
Figure 3C:
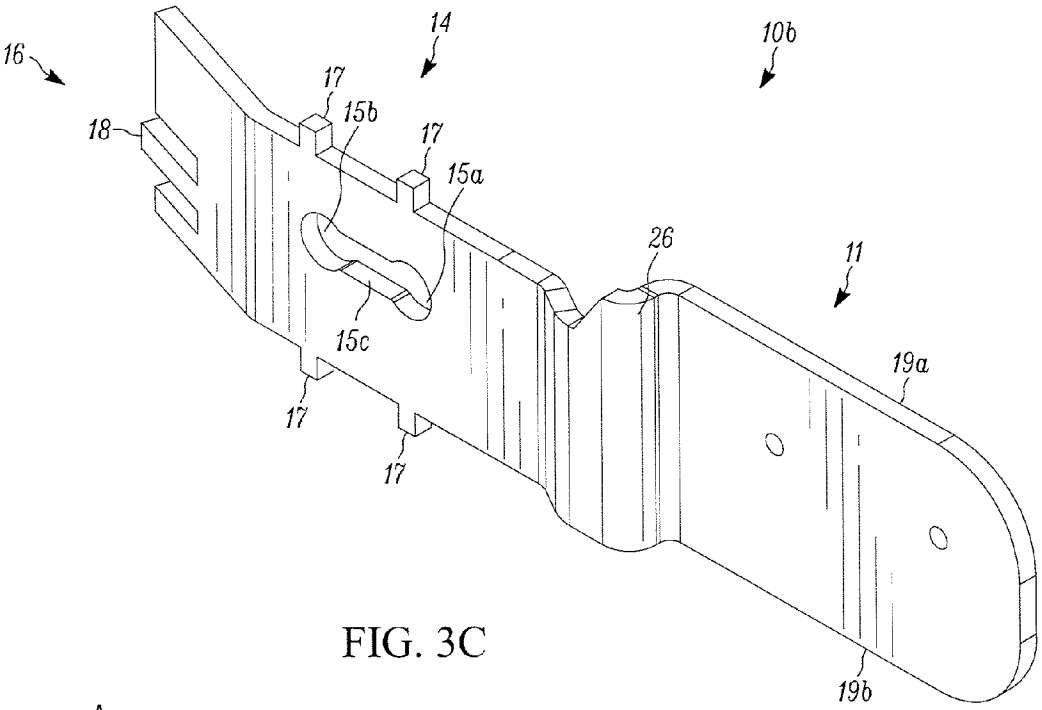

With further reference to FIGS. 3A and 3C, the arms 10*a*, 10*b* are configured to guard at least a portion of a trigger mechanism. In an embodiment, each arm 10*a*, 10*b* includes a first end 11 containing a trigger mechanism guarding surface 12 (shown in FIG. 1) configured to guard at least a portion of a trigger mechanism and a second end 16 configured to engage the spring mechanism 25 in the housing 20.

The trigger mechanism guarding surfaces 12 secure around at least a portion of a trigger mechanism of a firearm. As used herein, the term "firearm" refers not only to pistols, rifles, handguns and other portable guns, but also any structure, mechanism or assembly which releases a projectile upon activation of a trigger mechanism, such as, for example, a switch, trigger, button, lever or other device. Examples of firearms other than guns includes, for example, stun guns, tasers, Airsoft and paintball guns, and other non-lethal or less than lethal projectile devices.

Because different makes and models of firearms have different trigger mechanisms, for example, in terms of size, shape and proportions, the trigger mechanism guarding surfaces 12 used to secure one model of firearm may not be suitable for securing a different model of firearm. In one embodiment, therefore, the trigger mechanism guarding surfaces 12 may be specifically manufactured to correspond to a specific firearm and/or design of trigger mechanism or portion of a trigger mechanism. In further embodiments, and as shown in FIG. 1, the trigger mechanism guarding surfaces 12 are removable by screws 13 and may be replaced or exchanged with other trigger mechanism guarding surfaces of a different size, shape or proportion in order to secure a different make or model of firearm.

The arms 10*a*, 10*b* further include a second end 16 which contains a spring mechanism-engaging protuberance 18 around which spring mechanisms 25 are slidably engaged.

In an embodiment, the spring mechanisms 25 may be any spring mechanism which can change between a compressed and an extended (or relaxed) position. The spring mechanism 25 may be any spring mechanism that works with a linear motion. For example, in the embodiment shown, the spring mechanisms 25 are coil compression springs which are extended when in a relaxed state and compress when a load is applied.

In a further embodiment, the spring mechanisms 25 are made of coiled wire, such as steel, having a diameter of 0.050 inches to 0.030 inches, or preferably 0.045 inches to 0.035 inches, or more preferably 0.040 inches to 0.038 inches. The coiled spring mechanisms 25 have an outer diameter of 0.350 inches to 0.200 inches, preferably 0.300 inches to 0.250 inches, and more preferably 0.300 inches to 0.275 inches. The spring mechanisms 25 have a relaxed length of 2.00 inches to 0.75 inches, preferably 1.75 inches to 1.00 inches, and more preferably 1.50 inches to 1.20 inches. The spring mechanisms 25 have a compressed length of 1.00 inches to 0.25 inches, preferably 0.80 inches to 0.35 inches, and preferably 0.75 inches to 0.50 inches.

In a particularly preferred embodiment, the spring mechanisms 25 have are coiled springs having an outer coil diameter of 0.281 inches and are made of coiled wire having a diameter of 0.039 inches, a relaxed length of 1.25 inches, and a compressed length of 0.60 inches.

In an embodiment, the arms 10*a*, 10*b* also include a middle portion 14 containing a slide aperture 15 configured to engage the button mechanisms 30. In the exemplary embodiment shown as in FIGS. 3A and 3C, the slide apertures 15 are approximately bone-shaped have two rounded end portions 15*a*, 15*b* separated by an elongated channel portion 15*c*. The rounded end portions 15*a*, 15*b* have a diameter which is greater than the overall height of the elongated channel portion 15*c*. As will be described in detail later, the dimensions of the rounded end portions 15*a*, 15*b* relative to the elongated channel portion 15*c* permits the button mechanisms 30 to lock in position when engaging either of the rounded end portions 15*a*, 15*b*.

In some embodiments, middle portions 14 may also include one or more guiding protuberances 17 on one or both of the upper horizontal surface 19*a* or lower horizontal surface 19*b* of the arms 10*a*, 10*b*. In the exemplary embodiment shown, middle portions 14 include four total guiding protuberances 17, two on each horizontal surface 19*a*, 19*b* and positioned to approximately correspond with the rounded end portions 15*a*, 15*b* of the slide aperture 15.

Figure 3D:
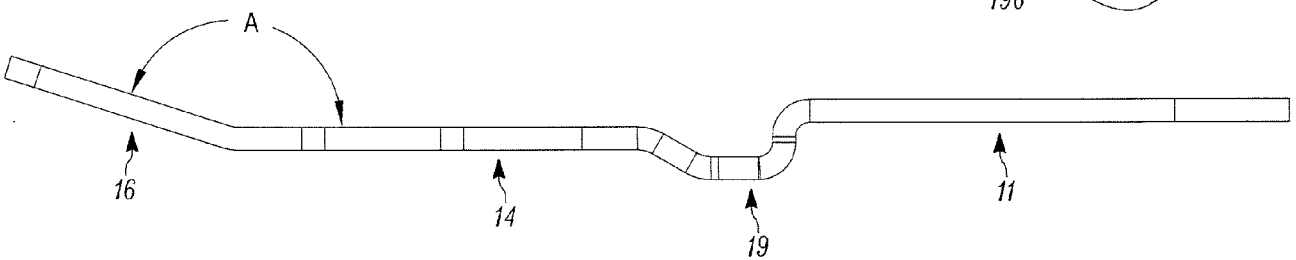

As illustrated in FIGS. 3B and 3D, in an embodiment, second ends 16 are angled at an angle of A relative to the middle portion 14. In the exemplary embodiment shown in FIG. 3, the second ends 16 are angled at an angle A of approximately 160° to 170° relative to the middle portion 14. In further embodiments, the second ends 16 are angled at an angle A of approximately 160° to 165°, or more preferably at 162°.

While the first ends 11 and middle portions 14 are approximately parallel with one on another, a transition portion 26 between the first ends 11 and middle portions 14 serves to offset them by a distance. In an embodiment, the first ends 11 and middle portions 14 are offset by a distance approximately equal to the thickness of the material of the arms 10*a*, 10*b*.

One specific embodiment of the arms 10*a*, 10*b* is described as follows. Arms 10*a*, 10*b* are each made of a rigid material, such as plastic or metal. Together, the first end 11 and middle portion 14 have a total length of 4.56 inches, with the second end 16 being angled at 162° relative to the first end 11 and middle portion 14. The transition portion 26 between the first end 11 and middle portion 14 includes a first 90° jog, a second 90° jog, a first 30° jog and a second 30° jog, bringing the middle portion 14 substantially parallel with the first end 11. The middle portion 14 includes slide aperture 15 with the distance from the center of the rounded end portion 15*a* to the center of the rounded end portion 15*b* being 0.52 inches. The height of the elongated channel portion 15*c* is 0.20 inches, and the diameter of the rounded end portions 15*a*, 15*b* is 0.28 inches.

In an embodiment, as shown in FIGS. 3A-3D, the middle portion 14 includes two guiding protuberances 17 on the upper horizontal surface 19*a* and two guiding protuberances 17 on the lower horizontal surface 19*b*. The length of and distance between guiding protuberances 17 can affect the motion of the housing 20 relative to the arms 10*a*, 10*b*, as the motion is described below. For example, changing the dimensions of the guiding protuberances 17 can affect the stroke length, or distance the housing 20 must move in order to close or separate the arms 10*a*, 10*b*, or speed at which the arms 10*a*, 10*b* open. In an embodiment, each guiding protuberance 17 has a length of 0.3 inches to 0.05 inches, or 0.25 to 0.10 inches. In an embodiment, the distance between guiding protuberances 17 as measured form the center of one to the center of the other is 0.40 inches to 0.75 inches, or 0.5 inches to 0.65 inches. In an exemplary embodiment, as shown in FIGS. 3A-3D, each guiding protuberance 17 has a length of 0.10 inches and the distance between the guiding protuberances 17 as measured from the center of one to the center of the other is 0.60 inches.

FIGS. 4A-5B illustrate an exemplary housing 20 for a trigger mechanism guard assembly 100. As shown, housing 20 includes a lower portion 20*a* and an upper portion 20*b* configured to secure together as a single unit and at least partially house the second ends 16 of arms 10*a*, 10*b*.

Figure 4A:
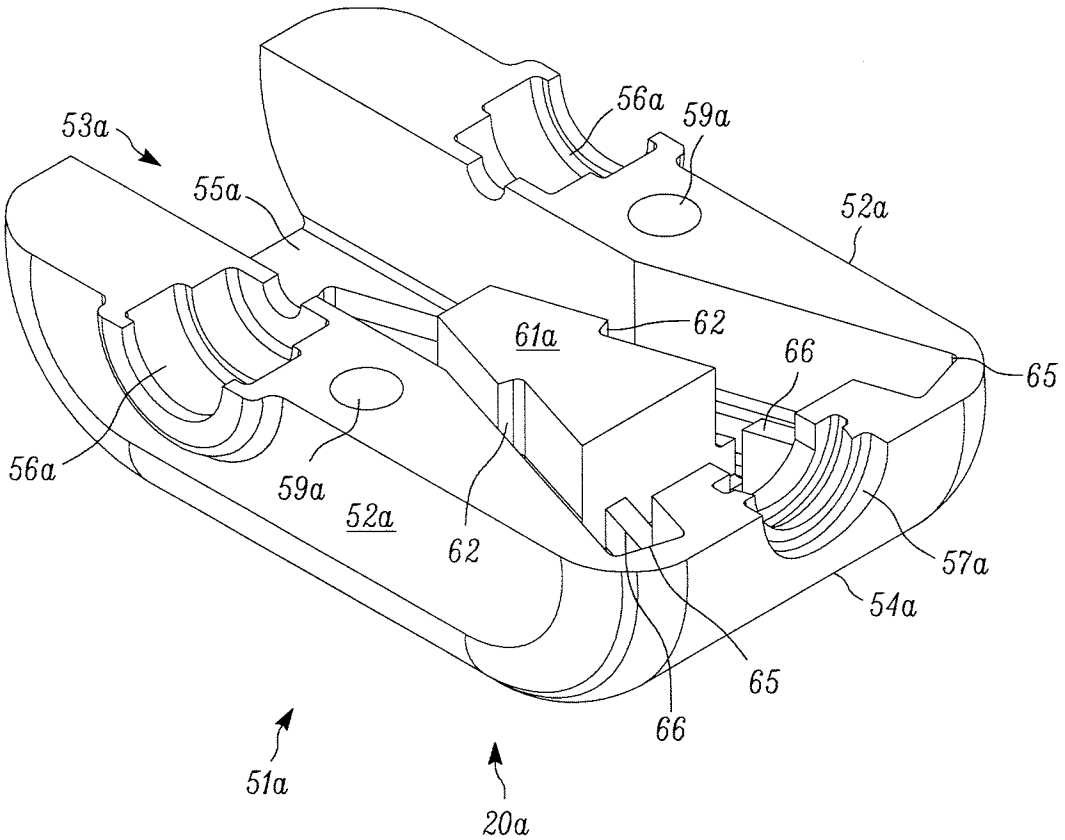
FIG. 4A is a perspective view of an exemplary lower portion of the housing for a trigger mechanism guard assembly.
Figure 4B:
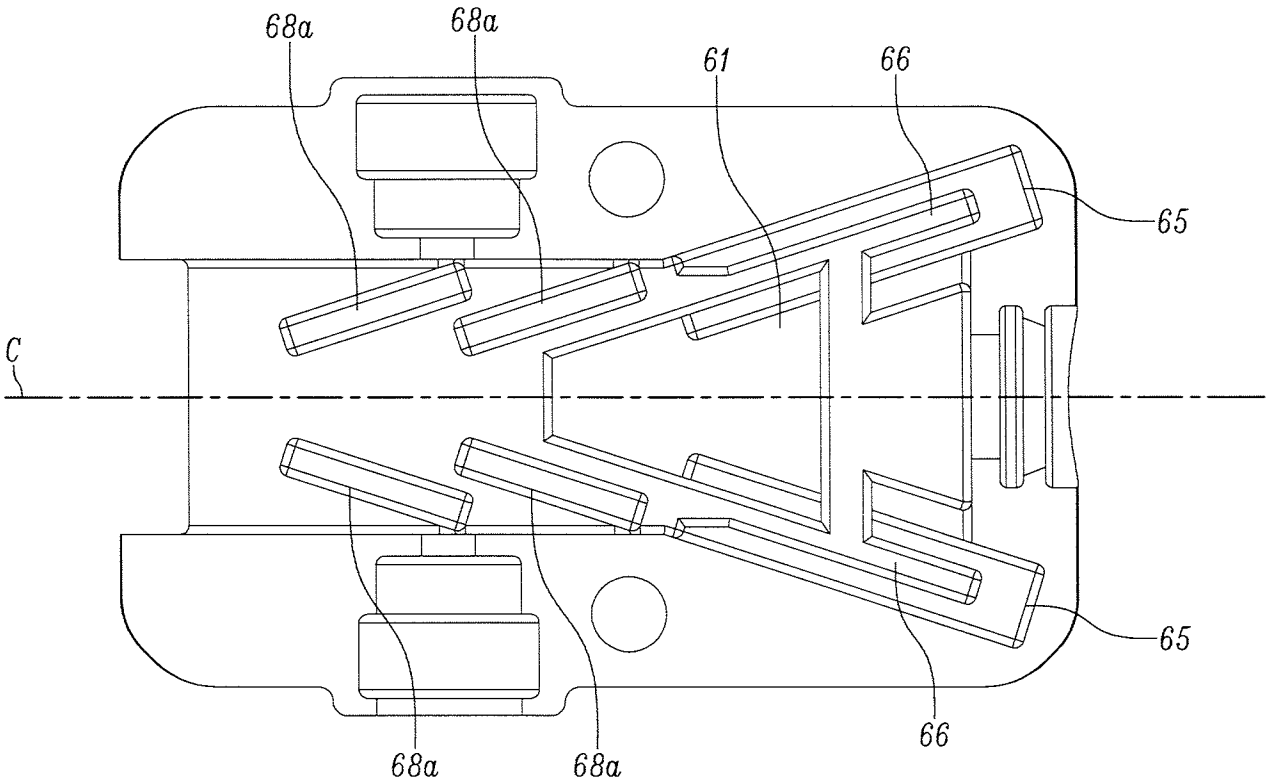
FIG. 4B is a top view of the exemplary lower portion of the housing shown in FIG. 4A.
Figure 5A:
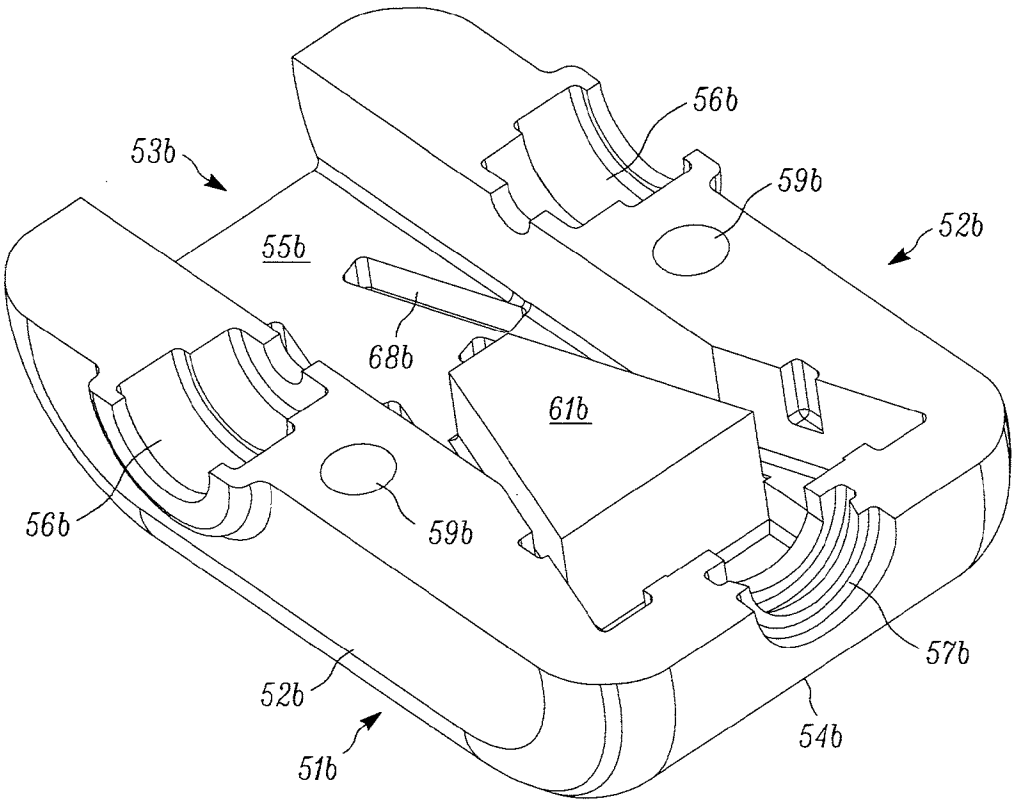
FIG. 5A is a perspective view of an exemplary upper portion of the housing for a trigger mechanism guard assembly.
Figure 5B:
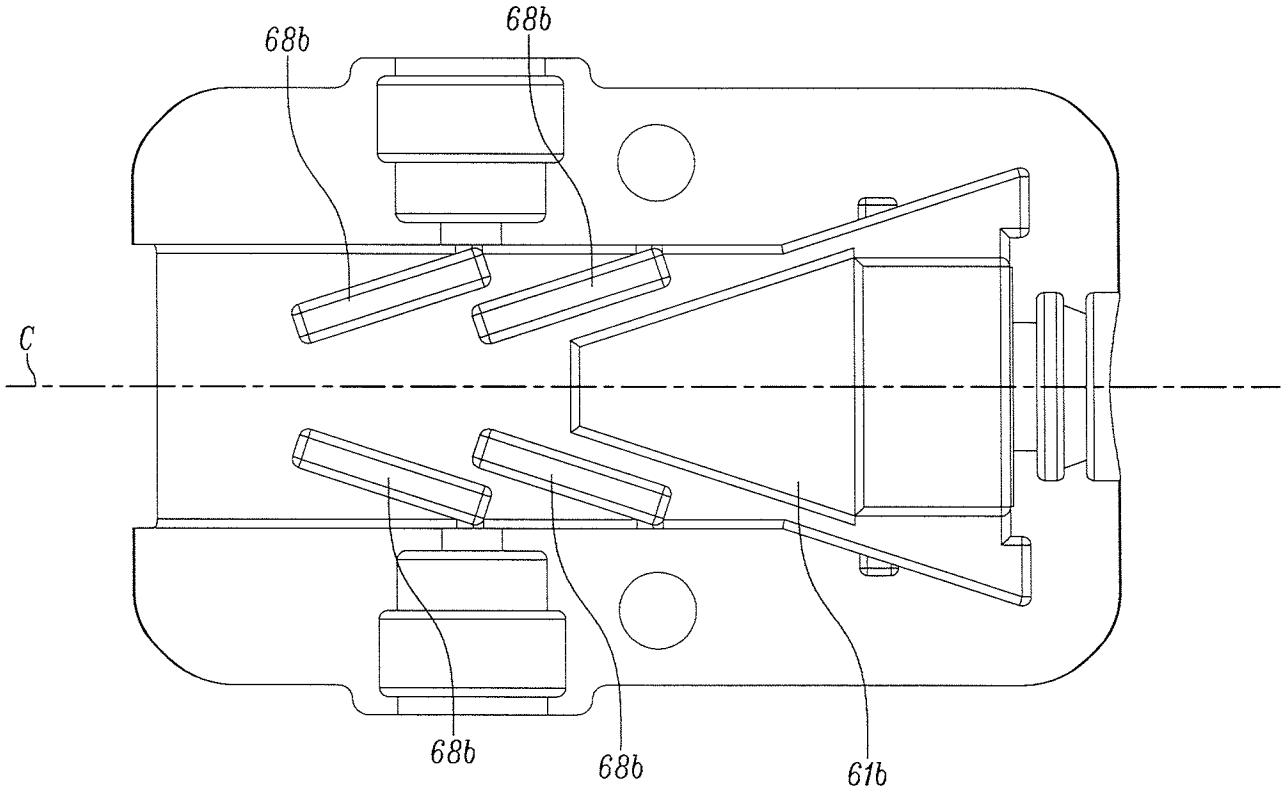
FIG. 5B is a bottom view of the exemplary upper portion of the housing shown in FIG. 5A.

In particular, FIGS. 4A and 4B show the lower portion 20*a* of an exemplary housing 20. The bottom portion 20*a* of housing 20 includes an outer body 51*a* having two sides 52*a*, each containing an approximately semi-circular depression 56*a*, a first end 53*a* which is open, a second end 54*a* with an approximately semi-circular depression 57*a* and a bottom surface 55*a*. FIGS. 5A and 5B show the upper portion 20*b* of an exemplary housing 20. The upper portion 20*b* of housing 20 also includes an outer body 51*b* having two sides 52*b*, each containing an approximately semi-circular depression 56*b*, a first end 53*b* which is open, a second end 54*b* with an approximately semi-circular depression 57*b*, and an upper surface 55*b*.

As shown in FIG. 2A, the upper and lower portions 20*a*, 20*b* of the housing 20 are configured to be securely joined together, releasably or unreleasably, to form the singe housing 20. In an embodiment, as shown in FIGS. 4A and 5A, sides 52*a*, 52*b* also include corresponding pin apertures 59*a*, 59*b* which receive pins 22 (shown in FIG. 1) to secure the lower portion 20*a* and upper portion 20*b* of housing 20 together. However, in further embodiments, the upper and lower portions 20*a*, 20*b* of the housing 20 may be joined using other structures and/or mechanisms which form a releasable connection between the upper and lower portions 20*a*, 20*b*, such as by clips, fasteners, screws, and adhesives. In still further embodiments, the upper and lower portions 20*a*, 20*b* of the housing 20 may be joined using unreleasably structures or methods, such as by welding or permanent adhesives.

Figure 2B:
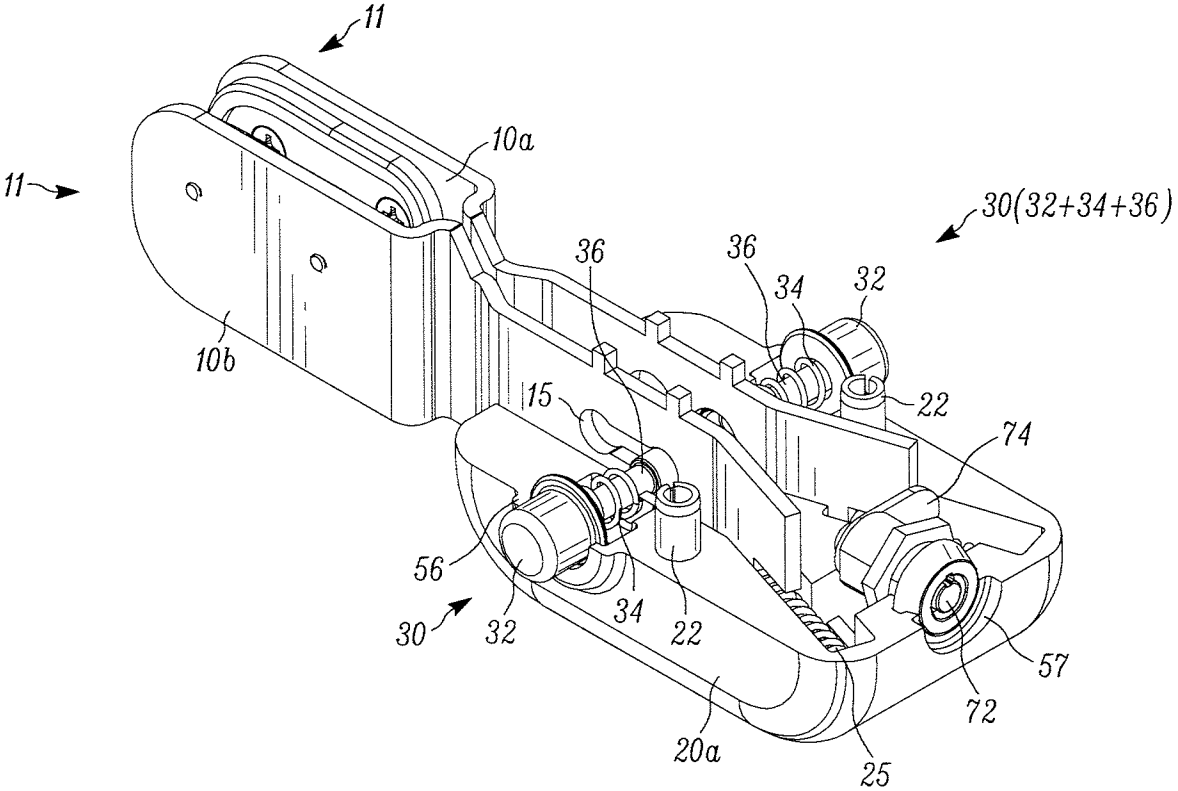
FIG. 2B illustrates the trigger mechanism guard assembly of FIG. 1 fully assembled with the upper housing removed.

As will be understood, when housing 20 is assembled, the respective semi-circular depressions 56*a*/56*b* and 57*a*/57*b* align to create apertures 56, 57 (as shown in FIGS. 2A and 2B) in the housing 20. As will be shown in FIGS. 2A and 2B, apertures 56 are button cavities which contain button mechanisms 30, and aperture 57 contains the optional locking mechanism 72 when included with trigger guard assembly 100.

As shown best in FIG. 1, the compressible button mechanism inserts 30 include a pin or pin-like structure 36 and a button structure 32. The pin or pin-like structure has a narrow body 35 around which a spring mechanism 34 is secured and a head portion 33 which together with the button structure 32 prevents the spring mechanism 34 from disengaging the pin or pin-like structure 36.

As will be understood with reference to FIGS. 1 and 2B, when the trigger guard assembly 100 is fully assembled, compressing the button mechanism inserts 30 permits the pin or pin-like structure 36 to be slidable in the slide apertures 15. The housing 20, as a whole, may then be moved either toward or away from the arms 10*a*, 10*b*. This movement will be described in further detail below.

With reference to FIGS. 1 and 2B, the optional locking mechanism 72 is illustrated as a standard keyed lock. When a key is inserted into the locking mechanism 72, the key is rotated, causing protuberance 74 to rotate. When in a locked position, the protuberance 74 prevents movement of the housing 20 relative to the arms 10*a*, 10*b*. When in an unlocked position, protuberance 74 permits movement of the housing 20 relative to the arms 10*a*, 10*b*. However, in further embodiments, the locking mechanism 72 may be any suitable structure or assembly to prevent the movement of the housing 20 relative to the arms 10*a*, 10*b*.

With reference to the embodiments shown in FIGS. 4A-4B and 5A-5B, lower portion 20*a* of housing 20 also includes an internal guiding structure 61*a*, which in the exemplary embodiment shown has an approximately trapezoidal shape with a lip 62 occurring at approximately half the length on both sides of guiding structure 61*a*. In an embodiment, the lip 62 serves as a contacting surface for the spring mechanisms 25 to ensure the spring mechanisms 25 remain engaged in the spring mechanism channels 66, described below. The upper portion 20*b* includes a similar guiding structure 61*b*, with the exception that guiding structure 61*b* does not include any lips, such that when the upper and lower housing portions 20*a*, 20*b* are assembled, the guiding structures 61*a*, 61*b* are adjacent one another. In an embodiment, the guiding structures 61*a*, 61*b* physically contact one another when housing 20 is assembled. In a further embodiment, the guiding structures 61*a*, 61*b* do not physically contact one another when housing 20 is assembled, such that there is a gap between guiding structures 61*a*, 61*b*.

In an embodiment, as shown in FIGS. 4B and 5B, the guiding structures 61*a*, 61*b* are symmetrically positioned with respect to a central line C and are generally trapezoidal with the sides of the trapezoidal shape occurring at an angle of approximately 10° to 25°, preferably 15° to 20°, and most preferably 18° relative to central line C.

In an embodiment, the lower portion 20*a* also includes spring mechanism-engaging surfaces 65, which in the embodiment shown are located at the end of spring mechanism channels 66. As will be understood, when the arms 10*a*, 10*b* are positioned within the assembled housing 20, the spring mechanism-engaging protuberances 18, around which the spring mechanisms 25 are positioned, are contained in the spring mechanism channels 66. The spring mechanisms 25 are prevented from disengaging the spring mechanism-engaging protuberances 18 by the spring-engaging surfaces 65. Movement of the housing 20 towards the arms 10*a*, 10*b* therefore compresses the spring mechanisms 25.

In an embodiment, as illustrated in FIGS. 4B and 5B, the lower portion 20*a*, also includes a plurality of guiding channels 68*a* and the upper portion 20*b* may include a plurality of corresponding guiding channels 68*b*. The guiding channels 68*a*, 68*b* correspond to guiding protuberances 17 on arms 10*a*, 10*b* when the housing 20 and arms 10*a*, 10*b* are assembled. Together, the corresponding guiding protuberances 17 and guiding channels 68*a*, 68*b* guide the movement of the housing 20 relative to the arms 10*a*, 10*b*, which will be described in further detail below.

Like the guiding structures 61*a*, 61*b*, the guiding channels 68*a*, 68*b* in the embodiment shown are symmetrically positioned with respect to a central line C and are generally parallel to the angled sides of the trapezoidal guiding structure 61*a*, 61*b*. In an embodiment, the guiding channels 68*a*, 68*b* are positioned at an angle of approximately 10° to 25°, preferably 15° to 20°, and most preferably 18° relative to central line C.

Figure 6:
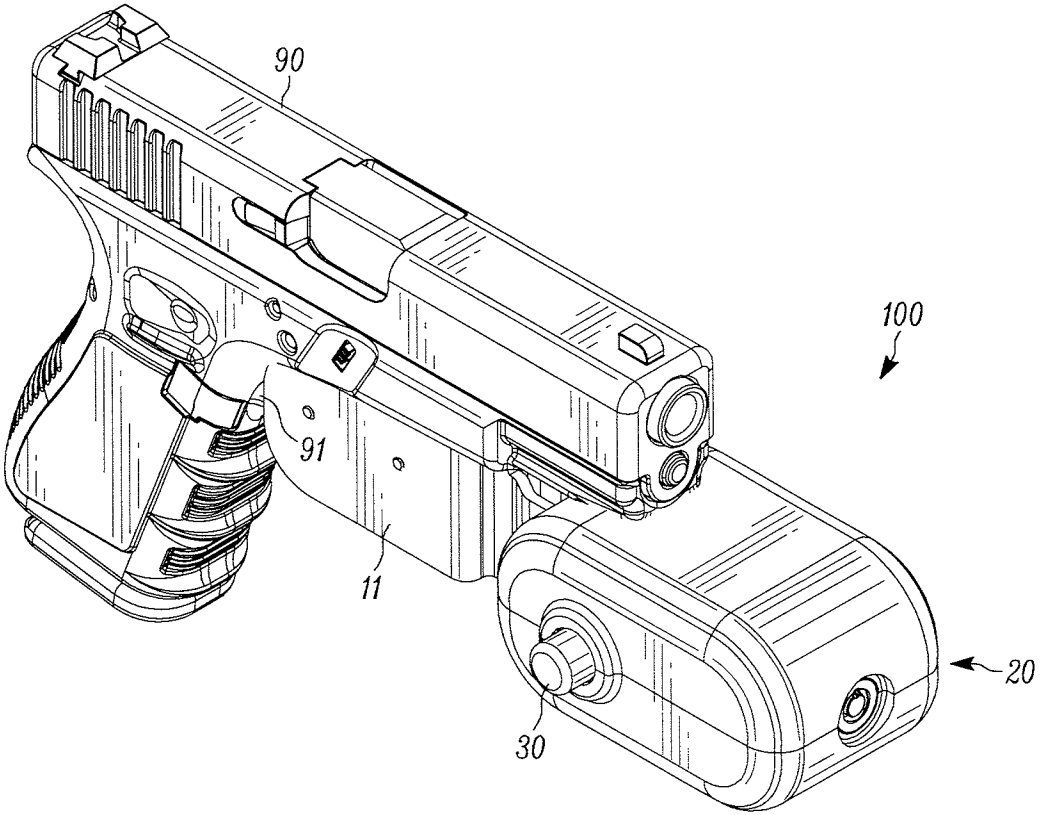
FIG. 6 illustrates an exemplary trigger mechanism guard assembly securing the trigger of a firearm.
Figure 7:
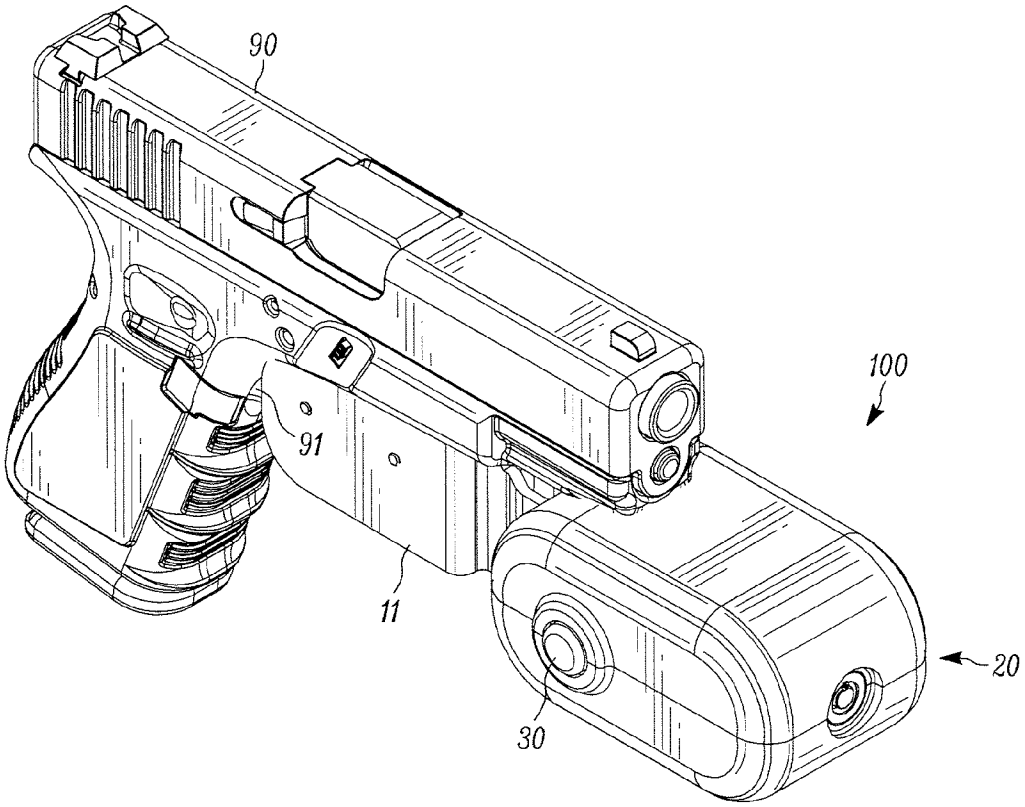
FIG. 7 illustrates an exemplary trigger mechanism guard assembly securing the trigger of a firearm with the button inserts compressed.
Figure 8:
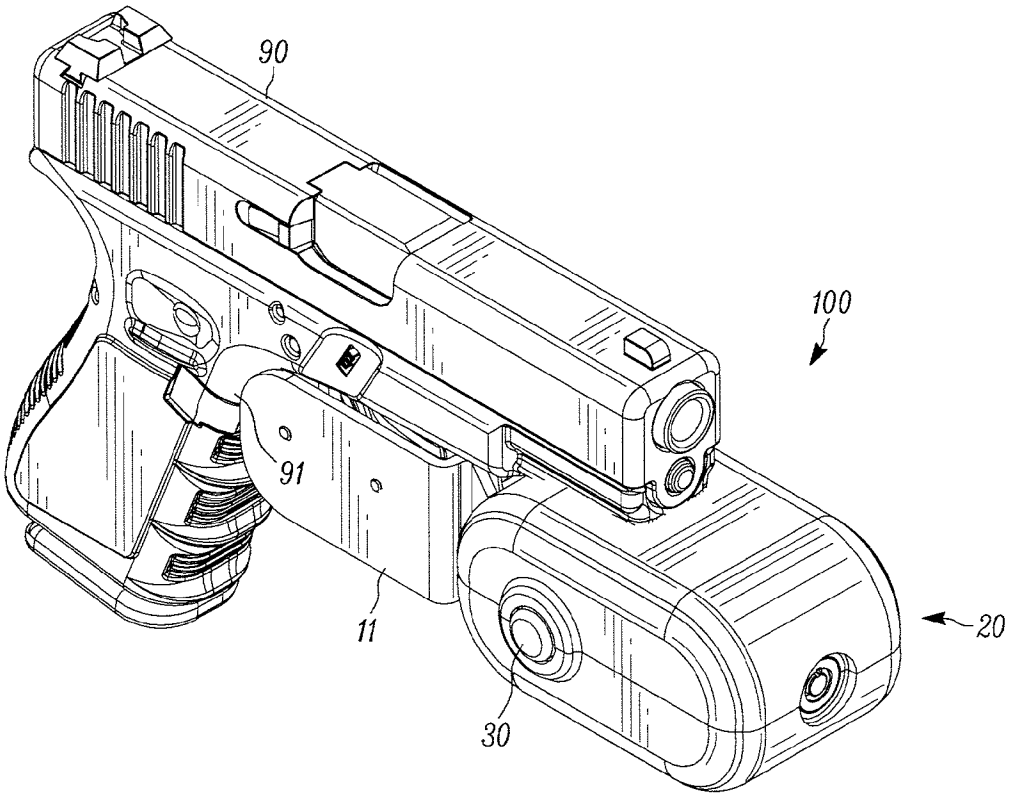
FIG. 8 illustrates an exemplary trigger mechanism guard assembly securing the trigger of a firearm with the housing moved forward compressing the spring mechanisms.

The movement of housing 20 relative to arms 10*a*, 10*b* is now described with reference to FIG. 2B and FIGS. 6-9. The housing 20 is configured to be movable with respect to the arms 10*a*, 10*b* such that the housing 20 has a first position and a second position. The second position, as illustrated in FIG. 8, is closer to the first ends 11 of the arms 10*a*, 10*b* compared to the first position, as illustrated in FIGS. 6-7. Movement of the housing 20 from the first position to the second position causes movement of the first ends 11 of the arms 10*a*, 10*b* away from each other.

In further detail, as shown in FIG. 2B, the optional locking mechanism 72 is actually shown in the locked position, with the protuberance 74 blocking the second end 16 of arm 10*b* from sliding within channel 66. In the embodiment shown in FIG. 2B, the spring mechanisms 25 are in the relaxed position, with the arms housing 20 in its furthest location from the first ends 11 of arms 10*a*, 10*b*. When the optional locking mechanism 72 is rotated to its unlocked position, the protuberance 74 moves out of the way of the second ends 16 of the arms 10*a*, 10*b*. Housing 20 can therefore move relative to the arms 10*a*, 10*b*, towards the first ends 11 of the arms 10*a*, 10*b*. Movement of the housing 20 towards the first ends 11 of the arms 10*a*, 10*b* causes the first ends 11 of the arms 10*a*, 10*b* to separate.

In an embodiment, the above-described movement of the arms 10*a*, 10*b*, regardless of whether the optional locking mechanism 72 is used, is further prevented or controlled by button mechanisms 30. When button mechanisms 30 are not compressed, movement of the housing 20 relative to the arms 10*a*, 10*b* is prevented by the engagement of the pin or pin-like structure 36 with the slide apertures 15. Specifically, in an embodiment, when the button mechanisms 30 are not compressed, the head portion 33 of the pin or pin-like structure 36 is engaged with the slide apertures 15, and specifically the rounded end portions 15*a* of the slide apertures 15. The pin or pin-like structures 36 are therefore prevented from moving through the slide apertures 15, and the housing 20 is thereby prevented from movement relative to the arms 10*a*, 10*b*.

When the compressible button mechanisms 30 are compressed, the head portion 33 of the pin or pin-like structure 36 moves inward to exit the rounded end portion 15*a* of the slide apertures 15 and the narrow body 35 of the pin or pin-like structure 36 is engaged in the slide apertures 15. The pin or pin-like structures 36 are therefore slidable in the slide apertures 15. As is understood, in order to fully effect movement of the housing 20 relative to the arms 10*a*, 10*b*, both button mechanisms 30 must be compressed simultaneously.

With the pin or pin-like structures 36 slidable in the slide apertures 15, housing 20 can moved towards the first ends 11 of arms 10*a*, 10*b*. As a user manually moves the housing 20, the spring mechanisms 25 begin to compress, thereby resisting the movement of the housing 20. Additional force is therefore required to continue moving the housing 20 relative to the arms 10*a*, 10*b*. In an exemplary embodiment, the force required move the housing 20 relative to the arms 10*a*, 10*b* is approximately 15 pounds to 30 pounds, depending on the specific spring mechanisms 25 used.

In a further exemplary embodiment, the spring mechanisms 25 are made of coiled wire, such as steel, having (a) a diameter of 0.050 inches to 0.030 inches, or preferably 0.045 inches to 0.035 inches, or more preferably 0.040 inches to 0.038 inches, (b) have an outer diameter of 0.350 inches to 0.200 inches, preferably 0.300 inches to 0.250 inches, and more preferably 0.300 inches to 0.275 inches, (c) have a relaxed length of 2.00 inches to 0.75 inches, preferably 1.75 inches to 1.00 inches, and more preferably 1.50 inches to 1.20 inches, and (d) have a compressed length of 1.00 inches to 0.25 inches, preferably 0.80 inches to 0.35 inches, and preferably 0.75 inches to 0.50 inches, and the force required to move the housing 20 is approximately 15 pounds to 30 pounds, or preferably 20 to 25 pounds.

In a particularly preferred embodiment, the spring mechanisms 25 have are coiled springs having an outer coil diameter of 0.281 inches and are made of coiled wire having a diameter of 0.039 inches, a relaxed length of 1.25 inches, and a compressed length of 0.60 inches, and the force required to move the housing 20 relative to the arms 10*a*, 10*b* is approximately 23 pounds.

The compressible button inserts 30 can be released as the housing 20 starts moving. The head portions 33 of the pin or pin-like structures 36 prevent the narrow body 35 of the pin or pin-like structures 36 from disengaging the channels 15*c*.

In an embodiment, as a result of the guiding apertures 17 engaging the guiding channels 68*a*, 68*b* of the housing 20, which are angled, and the internal guiding structures 61*a*, 61*b*, also angled, movement of the housing 20 also causes the first ends 11 of arms 10*a*, 10*b* to begin to separate.

Once the housing 20 is moved as far as permitted towards the first ends 11 of arms 10*a*, 10*b*, the pin or pin-like structures 36 have also reached the second rounded end portions 15*b*. The springs 24 of the button inserts 30, which were under tension when the narrow body 35 of the pins or pin-like mechanisms 36 were engaged in the channels 15*c*, are able to relax, causing the head portions 33 of the pin or pin-like structures 36 to engage the rounded end portions 15*b*, essentially locking the housing 20 in position with the spring mechanisms 25 in a compressed state.

FIG. 6 illustrates an exemplary trigger mechanism guard assembly 100 in combination with a firearm 90. In an embodiment, the trigger mechanism guard assembly 100 may be an embodiment or combination of embodiments as described herein.

As illustrated in FIG. 6, the exemplary trigger mechanism guard assembly 100 is securing at least a portion of a trigger mechanism 91 (shown in FIG. 9) of a firearm 90. Although the firearm 90 is illustrated as a handgun, the firearm may be any other firearm as described above.

In an embodiment, the arms 10*a*, 10*b* are tightly secured with respect to at least a portion of the trigger mechanism 91 of the firearm 90, or as illustrated, with respect the entire trigger portion 91. In an embodiment, the first ends 11 of arms 10*a*, 10*b*, and specifically the trigger mechanism guarding surfaces 12 of the first ends 11, may physically contact at least a portion of the trigger mechanism 91. However, in other embodiments, the first ends 11 of arms 10*a*, 10*b*, or specifically the trigger mechanism guarding surfaces 12, may be configured to surround or otherwise guard at least a portion of the trigger mechanism 91 without physically contacting any portion of the trigger mechanism 91 itself.

Because the arms 10*a*, 10*b* are tightened with respect to the trigger mechanism 91 of firearm 90 so as to guard the trigger mechanism from activation, it is understood that the housing 20 is in the position furthest away from the first ends 11 of arms 10*a*, 10*b*. In order to remove the trigger mechanism guard assembly 100 from the firearm 90, the housing 20 will need to be moved towards the first ends 11 of arms 10*a*, 10*b* to separate the arms 10*a*, 10*b*, as previously described with reference to FIG. 2B.

To begin disengaging the trigger mechanism guard assembly 100 from the firearm 90, the button inserts 30 are first depressed as shown in FIG. 7. As described with reference to FIG. 2B, the housing 20 is then moved towards the first ends 11 of the arms 10*a*, 10*b*, as shown in FIG. 8. In order to move the housing 20 towards the first ends 11 of the arms 10*a*, 10*b*, a user will need to use sufficient force to compress the spring mechanisms 25. This action mimics the pump action of a traditional pump action rifle and requires significant force to accomplish. The force necessary to compress the spring mechanisms 25 depends on the material of the wire of the spring mechanisms 25, the wire diameter, the coil diameter, or the length of the spring mechanism 25.

Figure 9:
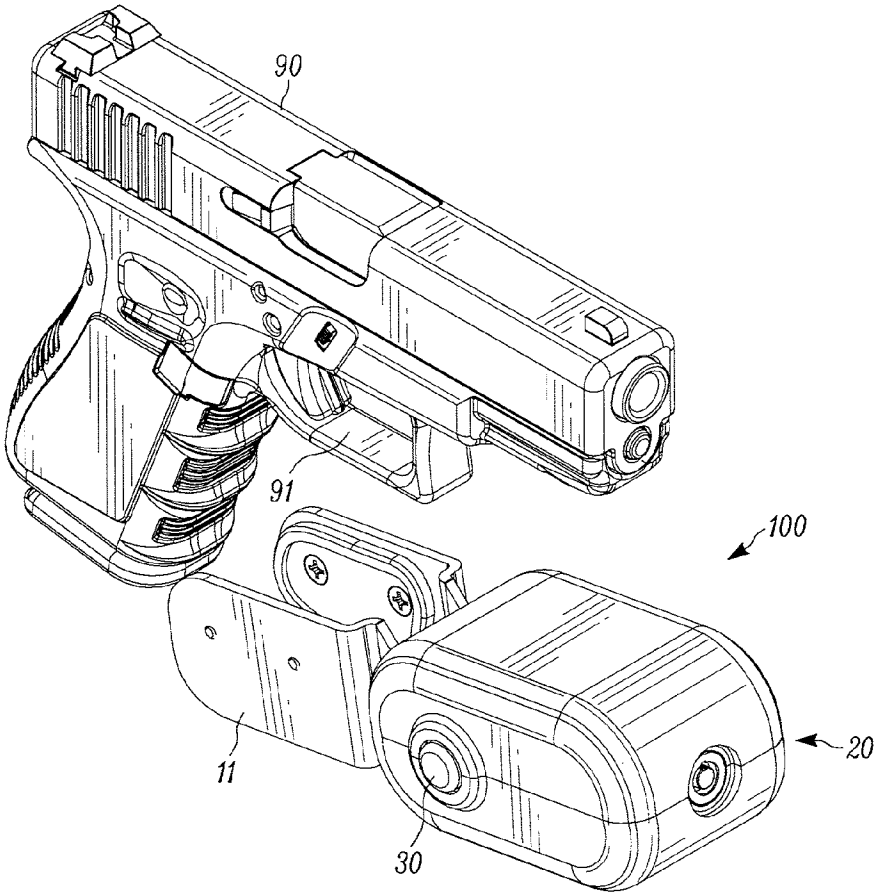
FIG. 9 illustrates an exemplary trigger mechanism guard assembly removed from the trigger of a firearm as a single unit.

As the arms 10*a*, 10*b* separate, they expose the trigger mechanism 91, or the at least a portion of the trigger mechanism 91, of the firearm 90, and the trigger guard assembly 100 is able to fall away from the firearm 90. As shown in FIG. 9, the trigger mechanism guard assembly 100 is removed from the firearm 90 as a single unit, e.g., the housing 20 remains fully assembled around the first ends 11 of arms 10*a*, 10*b*.

To once again secure the trigger mechanism guard assembly 100 with respect to the trigger mechanism 91, or at least a portion of the trigger mechanism 91, of the firearm 90, the trigger mechanism 91 or portion thereof is positioned between the first ends 11 of the arms 10*a*, 10*b*. Because the spring mechanisms 25 are already locked in the compressed position, once the compressible button mechanisms 30*a*, 30*b* are compressed, making the pin or pin-like structures 36 freely slidable in the slide apertures 15, the spring mechanisms 25 are able to release to their relaxed positions. The housing 20 is therefore forced back to its position furthest away from the first ends 11 of arms 10*a*, 10*b*, causing the first ends 11 of the arms 10*a*, 10*b* to tighten with respect to the trigger mechanism 91.

Figure 10B:
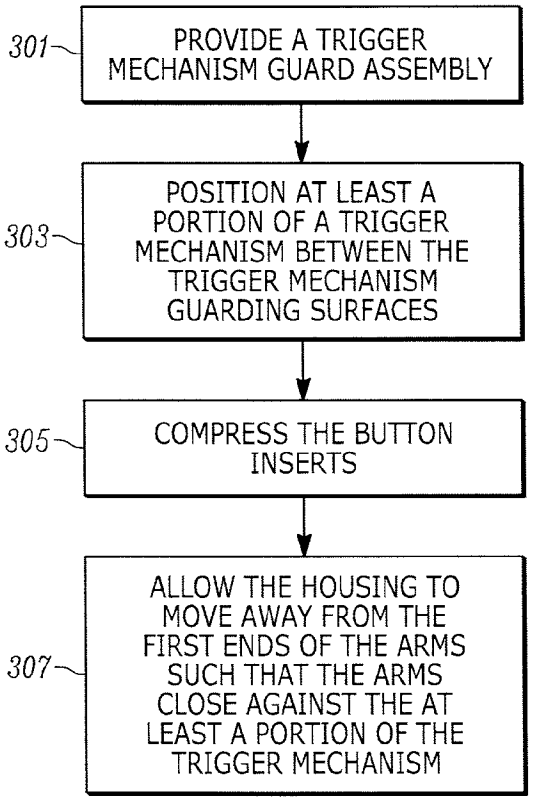
FIG. 10B is a flowchart showing the method of securing a trigger mechanism guard assembly to at least a portion of a trigger of a firearm.
Figure 10A:
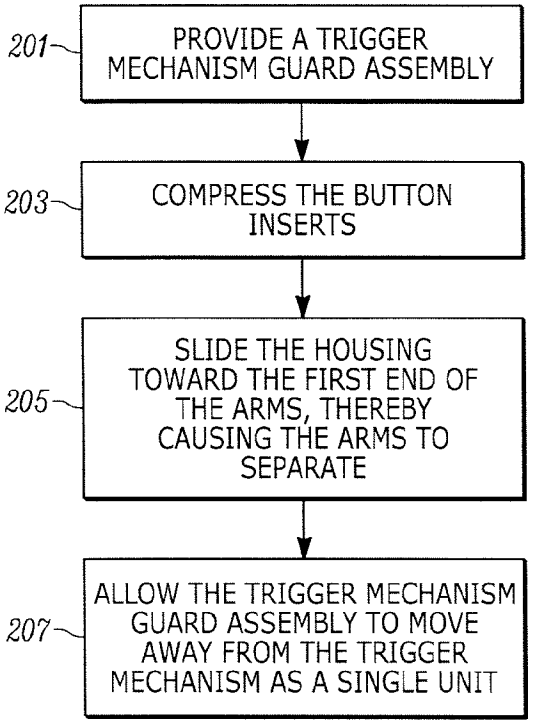
FIG. 10A is a flowchart showing a method of removing a trigger mechanism guard assembly from at least a portion of a trigger of a firearm.

FIG. 10A is a flowchart showing the steps for removing a trigger mechanism guard assembly from a trigger. Step 201 comprises providing a trigger guard assembly. The trigger mechanism guard assembly may be any embodiment or combination of embodiments as described herein.

In an embodiment, the step of providing a trigger mechanism guard assembly includes providing a trigger mechanism guard assembly having two arms, each arm having a first end with a trigger mechanism guarding surface and a second end with a spring mechanism-engaging protuberance; a housing at least partially enclosing the second ends of the two arms, the housing having two spring mechanism-engaging surfaces each corresponding with a spring mechanism-engaging protuberance and two button cavities containing compressible button mechanism inserts; two spring mechanisms, each spring mechanism having a compressed position and a relaxed position and each spring mechanism engaging one of the spring mechanism-engaging protuberances and secured by the corresponding spring mechanism-engaging surface. In an embodiment, the spring mechanisms are coil springs having an outer diameter of 0.350 to 0.200 inches and made from coiled wire having a diameter of 0.050 to 0.030 inches.

Step 203 comprises compressing the button inserts. Step 205 comprises sliding the housing toward the first end of the arms, thereby causing the arms to separate. In an embodiment, the step of sliding the housing toward the first end of the arms 205 further includes compressing the spring mechanisms into the compressed position. Step 207 comprises allowing the trigger mechanism guard assembly to move away from the trigger mechanism as a single unit.

In an embodiment, the arms of the trigger mechanism guard assembly include a middle portion with a slide aperture which engages the compressible button inserts and the step of compressing the button inserts 203 further includes compressing the button inserts such that at least a portion of the button inserts is slidable within the slide apertures.

In an embodiment, the trigger mechanism guard assembly further includes a locking mechanism, and the method for removing the trigger guard from the at least a portion of a trigger mechanism further comprises unlocking the locking mechanism.

FIG. 10B is a flowchart showing the steps for securing a trigger mechanism guard assembly to a trigger mechanism or at least a portion of a trigger mechanism. Step 301 comprises providing a trigger mechanism guard assembly. The trigger mechanism guard assembly may be any embodiment or combination of embodiments as described herein.

In an embodiment, the step of providing a trigger mechanism guard assembly includes providing a trigger mechanism guard assembly having two arms, each arm having a first end with a trigger mechanism guarding surface and a second end with a spring mechanism-engaging protuberance; a housing at least partially enclosing the second ends of the two arms, the housing having two spring mechanism-engaging surfaces each corresponding with a spring mechanism-engaging protuberance and two button cavities containing compressible button mechanism inserts; two spring mechanisms, each spring mechanism having a compressed position and a relaxed position and each spring mechanism engaging one of the spring mechanism-engaging protuberances and secured by the corresponding spring mechanism-engaging surface. In an embodiment, the spring mechanisms are coil springs having an outer diameter of 0.350 to 0.200 inches and made from coiled wire having a diameter of 0.050 to 0.030 inches.

Step 303 comprises positioning at least a portion of a trigger mechanism with respect to (e.g., between) the trigger mechanism guarding surfaces. Step 305 comprises compressing the button inserts. Step 307 comprises allowing the housing to move away from the first ends of the arms such that the arms close against the at least a portion of the trigger mechanism.

In an embodiment, the trigger mechanism guard assembly further includes a locking mechanism, and the method for securing the trigger mechanism guard assembly to at least a portion of a trigger mechanism further comprises locking the locking mechanism.

It shall be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

We claim:

1. A trigger mechanism guard assembly comprising:

two arms, each having a first end comprising a trigger guarding surface and a second end;

a housing having substantially parallel side surfaces and two spring mechanism-engaging surfaces each corresponding with one of the second ends of the arms, the housing at least partially enclosing the second ends of the arms;

two spring mechanisms, each spring mechanism having a compressed position and a relaxed position and each spring mechanism engaging one of the second ends of the arms and secured by the corresponding spring mechanism-engaging surfaces; and two compressible button mechanisms, each engaging one of the arms, wherein compression of the button mechanisms permits movement of the housing relative to the two arms to change the spring mechanisms from the relaxed position to the compressed position, wherein the movement of the spring mechanisms to the compressed position causes movement of the first ends of the arms away from each other.

2. The trigger mechanism guard assembly of claim 1, wherein the second ends of the arms each comprise a spring mechanism-engaging protuberance, and wherein each spring mechanism is engaged with a respective spring mechanism-engaging protuberance.

3. The trigger mechanism guard assembly of claim 1, wherein the spring mechanisms have an outer diameter of 0.350 to 0.200 inches and are made from coiled wire having a diameter of 0.050 to 0.035 inches.

4. The trigger mechanism guard assembly of claim 1, wherein the housing further includes a plurality of guiding channels and the arms further include a plurality of guiding protuberances, wherein each of the guiding protuberances corresponds to a respective guiding channel and wherein each of the guiding channels is angled at 10° to 25° relative to a central line substantially parallel with the first ends of the arms.

5. The trigger mechanism guard assembly of claim 1 in combination with a firearm.

6. A trigger guard assembly comprising:

two arms, each arm having a first end comprising a trigger mechanism guarding surface, a second end comprising a spring mechanism-engaging protuberance, and a middle portion connecting the first and second ends and having a slide aperture for receiving a button mechanism insert;

a housing at least partially enclosing the second ends and middle portions of the two arms, the housing having two spring mechanism-engaging surfaces each corresponding with a spring mechanism-engaging protuberance and two button cavities for receiving the button mechanism inserts;

two spring mechanisms, each spring mechanism having a compressed position and a relaxed position and each spring mechanism engaging one of the spring mechanism-engaging protuberances and secured by the corresponding spring mechanism-engaging surface; and two compressible button mechanism inserts, each engaging both of the slides;

wherein compression of the button mechanism inserts permits movement of housing relative to the two arms to change the springs from the relaxed position to the compressed position.

7. The trigger guard assembly of claim 6 wherein the two spring mechanisms have an outer diameter of 0.350 to 0.300 inches and are made from coiled wire having a diameter of 0.050 to 0.030 inches.

8. The trigger guard assembly of claim 6 wherein the two arms further comprise a plurality of guiding protuberances on the middle portions of the arms and the housing further includes a corresponding plurality of guiding channels.

9. The trigger guard assembly of claim 8 wherein the upper surface of the middle portion of the arms contain at least two guiding protuberances and the lower surface of the middle portion of the arms contain at least two guiding protuberances.

10. The trigger guard assembly of claim 9 wherein the housing comprises an upper portion containing at least two guiding channels and a lower portion containing at least two guiding channels, each corresponding to one of the guiding protuberances, wherein the guiding channels are positioned at an angle of 10° to 25° relative to a central line substantially parallel with the arms.

11. The trigger guard assembly of claim 6 wherein the button mechanism inserts comprise a button portion, a pin or pin-like structure and a spring mechanism.

12. The trigger guard assembly of claim 11 wherein the pin or pin-like structures include a head portion and a narrow body portion, and wherein the springs are secured around the corresponding narrow body portions and are prevented from disengaging the narrow body portions by the button portions and the head portions.

13. The trigger guard assembly of claim 12 wherein the slide apertures each comprise a narrow channel portion with rounded end portions on both sides of the channel portions.

14. The trigger guard assembly of claim 13 wherein the diameter of the head portions of the pin or pin-like structures is greater than the diameter of the narrow channel portion of the slide apertures.

15. The trigger guard assembly of claim 13 wherein the diameter of the narrow body portion of the pin or pin-like structures is less than the height of the narrow channel portion of the slide apertures.

16. A method of using the trigger mechanism guard assembly of claim 5 comprising:

providing the trigger mechanism guard assembly; and at least one of removing the trigger mechanism guard assembly from at least a portion of a trigger mechanism and securing the trigger mechanism guard assembly to at least a portion of a trigger mechanism, wherein the step of removing the trigger mechanism guard assembly from at least a portion of a trigger mechanism comprises compressing the button inserts; sliding the housing toward the first end of the arms, thereby causing the two arms to separate; and allowing the trigger mechanism guard assembly to move away from the trigger mechanism as a single unit; and wherein the step of securing the trigger mechanism guard assembly to at least a portion of a trigger mechanism comprises position at least a mechanism portion of a trigger mechanism with respect to the trigger mechanism guarding surfaces, compressing the button inserts, and allowing the housing to move away from the first ends of the arms such that the arms close against the at least a portion of the trigger mechanism.

17. The method of claim 16 wherein the step of removing the trigger guard assembly comprises sliding the housing toward the first end of the arms and compressing the spring mechanisms into the compressed position.

18. The method of claim 16 wherein the arms further comprise a middle portion having a slide aperture which engage the compressible button inserts and wherein the step of removing the trigger guard assembly further comprises compressing the button inserts such that at least a portion of the button inserts is slidable within the slide apertures.

19. The method of claim 16 wherein the middle portions of the arms each contain an upper surface comprising at least two guiding protuberances and a lower surface comprising at least two guiding protuberances, wherein the housing comprises an upper portion having two sides and at least four guiding channels, each corresponding to a respective guiding protuberance on the upper surface of the middle portion of the arms, and a lower portion having two sides and at least four guiding channels, each corresponding to a respective guiding protuberance on the lower surface of the middle portion of the arms, wherein the guiding channels are positioned at an angle of 10° to 25° relative to a central line substantially parallel with the arms; wherein the step of sliding the housing toward the first end of the arms causes the guiding channels to force the guiding protuberances towards the sides of the housing, thereby causing the two arms to separate, and wherein the step of allowing the housing to move away from the first ends of the arms causes the guiding channels to force the guiding protuberances away from the sides of the housing, thereby causing the two arms to close.

* * * * *